United States Patent [19]

Beck

[11] Patent Number: 4,793,501

[45] Date of Patent: Dec. 27, 1988

[54] WATER TIGHT HINGE CLOSURE

[75] Inventor: James M. Beck, Carol Stream, Ill.

[73] Assignee: Creative Packaging Corp., Wheeling, Ill.

[21] Appl. No.: 169,328

[22] Filed: Mar. 17, 1988

[51] Int. Cl.[4] ..... B65D 51/18

[52] U.S. Cl. ..... 215/235; 220/339; 222/517

[58] Field of Search ..... 215/235, 237; 220/254, 220/339; 222/556, 546, 545, 108, 517

[56] References Cited

U.S. PATENT DOCUMENTS

| | | | |
|---|---|---|---|
| 2,342,477 | 8/1941 | Magnenat | 220/338 |
| 3,022,925 | 4/1959 | Daniell | 222/517 |
| 3,252,492 | 5/1966 | Marchant | 220/338 X |
| 4,010,875 | 3/1977 | Babiol | 215/235 X |
| 4,193,519 | 3/1980 | Dubach et al. | 222/517 X |
| 4,220,248 | 9/1980 | Wilson et al. | 215/235 |
| 4,310,105 | 1/1982 | Gach | 222/556 X |
| 4,377,247 | 3/1983 | Hazard et al. | 215/235 X |
| 4,545,495 | 10/1985 | Kinsley | 222/517 X |
| 4,625,898 | 12/1986 | Harzard | 222/517 |
| 4,635,823 | 1/1987 | Stull | 222/108 |
| 4,711,360 | 12/1987 | Ullman | 215/235 |

*Primary Examiner*—Donald F. Norton

*Attorney, Agent, or Firm*—Silverman, Cass, Singer & Winburn, Ltd.

[57] ABSTRACT

A watertight hinge closure for a dispensing container. The closure has a lid with a solid unitary one-piece hinge which snaps shut onto a cap body integrally formed therewith. The lid and hinge are formed to leave a minimal space between the lid, the hinge and the cap body when the closure is in the shut position. The top of the cap body has a raised portion which is angled toward the snap fit portion of the lid opposite the hinge to prevent seepage and to avoid stagnant areas which could cause contamination.

16 Claims, 2 Drawing Sheets

FIG. 1
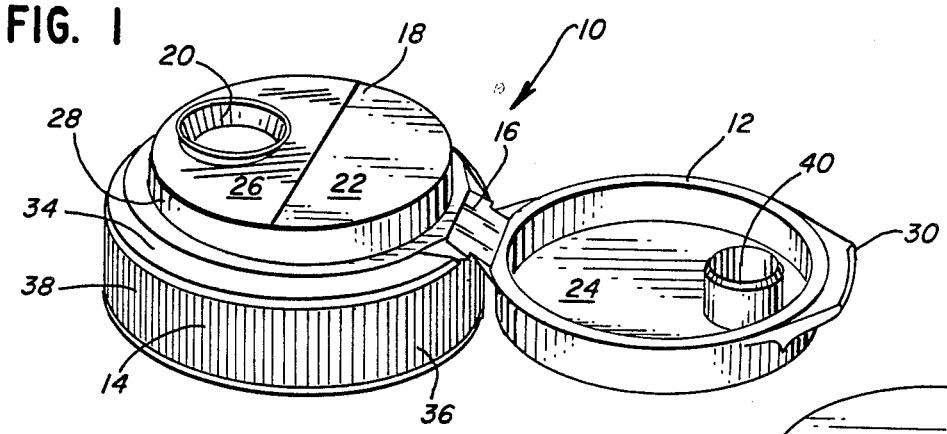
FIG. 2
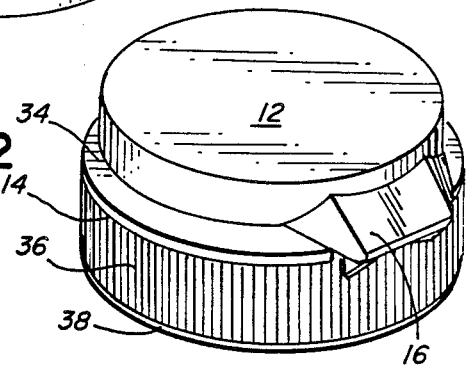
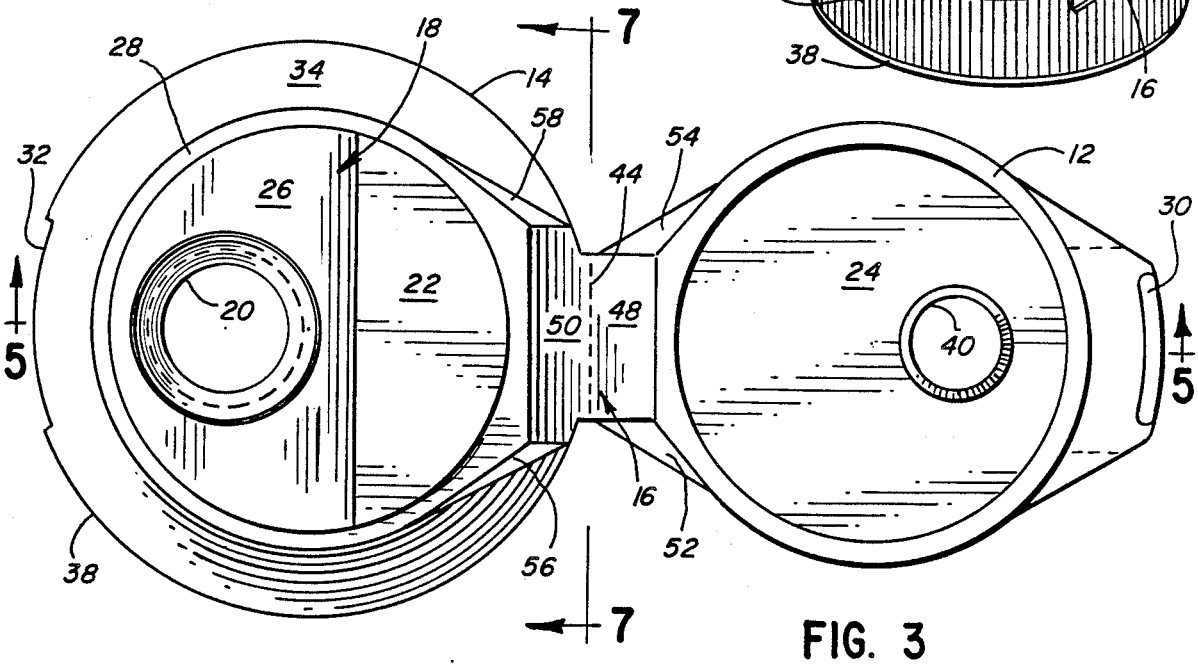
FIG. 3
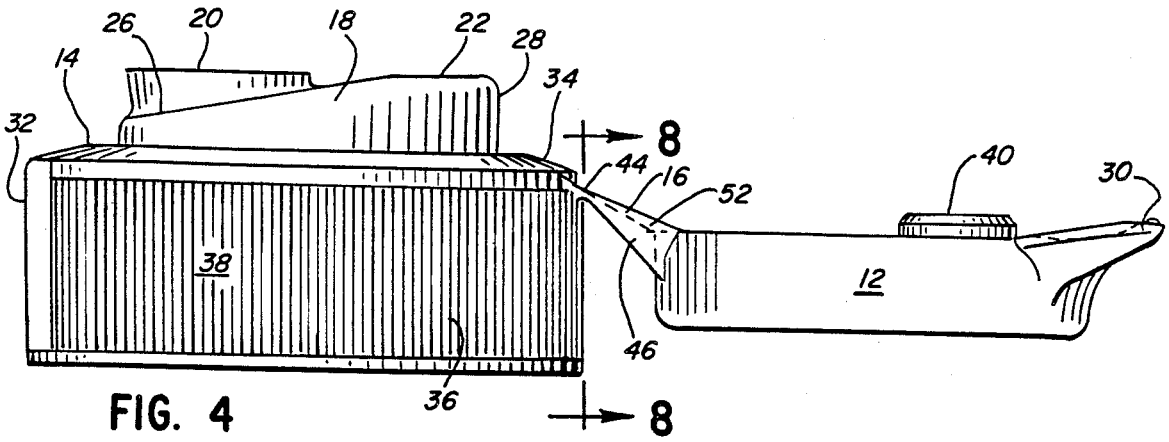
FIG. 4

WATER TIGHT HINGE CLOSURE

BACKGROUND OF THE INVENTION

The invention relates generally to hinge closure for a dispensing container and more particularly to a water tight hinge closure which minimizes seepage and contamination under the cap.

Dispensing containers frequently have one of two types of closures. Originally dispensing closures primarily utilized closures employing spouts mounted so as to be capable of being moved between open and closed positions. A second type of closure has a pivotally mounted lid capable of being moved between a closed and an open dispensing position. In the closed position, the lid covers the dispensing opening and in the open position, the lid is moved away from the opening to allow the product in the container to be dispensed.

A marked disadvantage of prior art hinged lid closures has been that they are susceptible to leakage and contamination in and around the lid when the lid is closed onto the cap body. Some of the prior art closures have multi-part hinge assemblies which have clearance space around the hinge which allows seepage of fluids therearound causing potential contamination. Some of the cap bodies have a flat or planar top only slightly raised from the edge of the lid when closed, which again are susceptible to seepage. Further, the planar top can bow or dish inwardly to provide an accumulation area for potential contamination. One structure also includes a depression in the top of the cap body around the dispensing opening which provides a large contamination accumulation area. Typically, prior art closures have a clearance spacing between the bottom of the lid and the top of the cap body on the order of 0.050 to 0.200 inches.

It thus would be desirable to provide a hinged closure with a snap shut lid which is integrally formed with the cap body and has minimal seepage and contamination.

SUMMARY OF THE INVENTION

The above and other disadvantages of the prior art dispensing closures are overcome in accordance with the present invention by providing a unitary watertight hinge closure. The closure has a lid with a solid one-piece hinge which snaps shut onto a cap body over the dispensing opening and is integrally formed therewith. The cap body has a raised top portion which includes an angled portion which is inclined below the dispensing opening toward the snap fit portion of the lid opposite the hinge. The top raised portion, hinge and the lid are designed to provide a minimal space therebetween when the lid is shut to prevent seepage and to avoid stagnation areas which could cause contamination.

BRIEF DESCRIPTION OF THE DRAWINGS

FIG. 1 is a perspective view of one embodiment of a watertight hinge closure of the invention in the open position;

FIG. 2 is a perspective view of the hinge closure of FIG. 1 in the closed position:

FIG. 3 is a top plan view of the closure of FIG. 1;

FIG. 4 is a side plan view of the closure of the invention;

DESCRIPTION OF THE PREFERRED EMBODIMENTS

Figure 5:
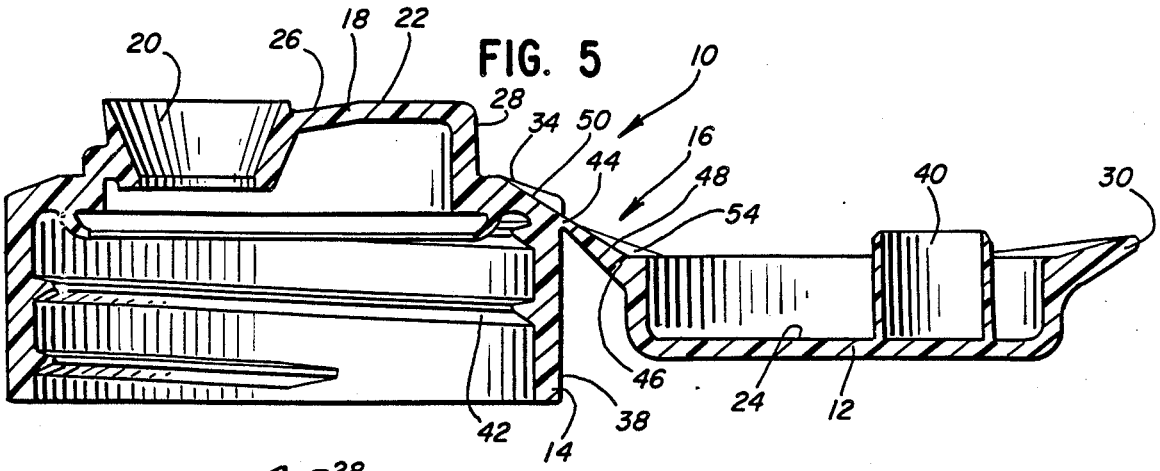
FIG. 5 is a side sectional view of the closure of FIG. 3 taken along the line 5—5 thereof.

Referring to FIGS. 1–4, one embodiment of a watertight hinge closure of the invention is designated generally by the reference numeral 10. The closure 10 includes a hinged lid 12 and a cap body 14, preferably formed in one piece, such as by molding from a strong resilient plastic, such as polypropylene. The lid 12 includes a unitary hinge 16 formed to minimize any clearance between the lid 12 and the cap body 14 when the lid 12 is closed, as illustrated in FIG. 2.

The cap body 14 includes a raised upper wall or top portion 18 which includes a dispensing opening 20 therethrough. The top portion 18 includes a first planar portion 22, which is designed to provide a minimal clearance between the surface thereof and a bottom wall 24 of the lid 12, when the lid 12 is closed. The clearance is on the order of 0.010 inches. The portion 18 includes a second inclined or ramp portion 26, which provides clearance for fluid to be expelled as the lid 12 is closed and clearance for the lid 12 to be securely snap closed over a periphery 28 of the top portion 18. The upper surface of the ramp 26 is below the top of the dispensing opening 20.

The lid 12 preferably includes a lift tab extension 30, which extends over a facet 32, which can be curved or flat, formed in the cap body 14, to provide a projection to assist in opening the lid 12 which is securely snapped shut over the periphery 28. The cap body 14 additionally includes a ramp or sloped peripheral perimeter shoulder 34 below the top portion 18, which further aids in preventing water or other contaminants from seeping under the closed lid 12. The cap body 14 preferably includes a plurality of finger ridges 36 around a side wall 38 to aid in securing and removing the closure 10 on a container, not illustrated. The lid 12 includes a plugging structure 40 which depends from the inside thereof to mate with the inside of the opening 20 to close the opening when the lid 12 is closed.

Figure 6:
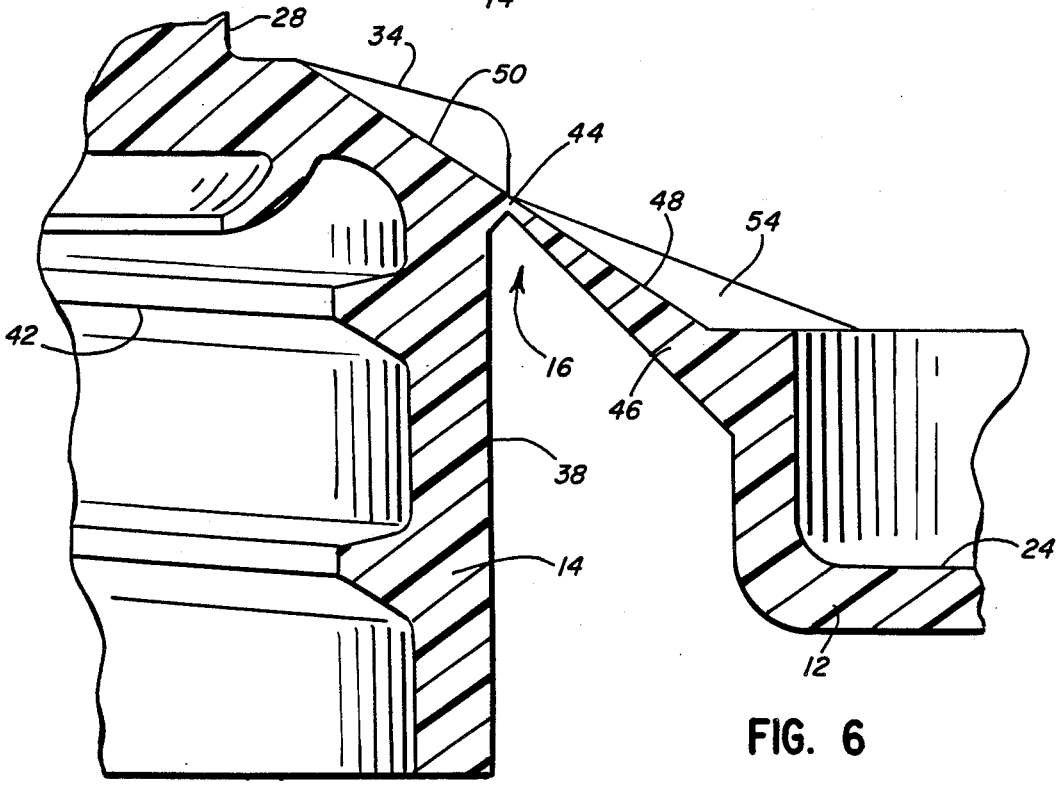
FIG. 6 is an enlarged partial side sectional view of a portion of the closure of FIG. 5.
Figure 7:
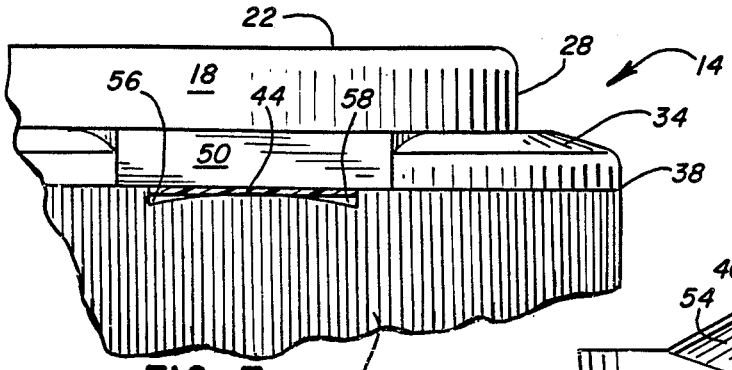
FIG. 7 is a partial side sectional view of the closure cap body of FIG. 3 taken along the line 7—7 therein.
Figure 8:
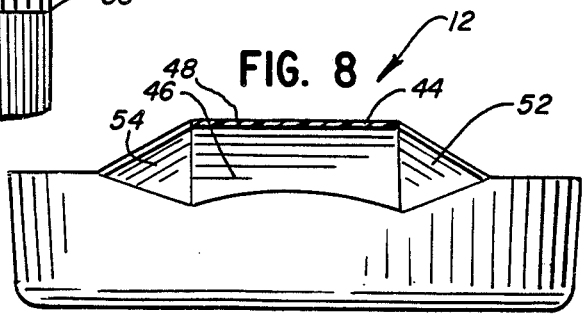
FIG. 8 is a side sectional view of the closure lid of FIG. 4 taken along the line 8—8 therein.

The hinge 16 is designed to provide a minimal amount of clearance space to prevent any possible seepage between the hinge 16, the lid 12 and the cap body 14 when the lid 12 is closed, as best illustrated in FIGS. 5–8. The cap body 14 preferably includes a plurality of inner threads 42 to allow the closure 10 to be secured to the top of the dispensing container.

The hinge 16 includes a hinge joint 44 adjacent the side wall 38 of the cap body 14. A hinge arm 46 connects the hinge 16 to the lid 12. A central planar portion 48 of the hinge arm 46 is designed to mate against a complementary planar portion or ramp 50 formed in the shoulder 34 of the cap body 14, eliminating seepage space therebetween when the lid 12 is closed.

Further, assisting in eliminating any seepage around the hinge 16 are a pair of raised side walls or shoulders 52, 54 formed at an inclined angle with and joining the planar portion 8 and the lid 12 (see also FIG. 3). When the lid 12 is shut, the shoulders 52 54 are seated into complementary grooves 56, 58 formed in the shoulder 34 adjacent and joining the ramp 50. This hinge construction eliminates any seepage around the hinge 16, when the closure 10 is closed and fitted onto a container. The watertight hinge closure 10 was tested by placing it in water bath after the container was filled. In the same test, prior vessels which were tested, were susceptible to leakage around the hinge structures.

Modifications and variations of the present invention are possible in light of the above teachings. It is therefore to be understood that within the scope of the appended claims, the invention may be practiced otherwise than as specifically described.

What is claimed and desired to be secured by Letters Patent of the United States is:

1. A watertight hinge closure, comprising:

a cap body portion adapted to be secured to a container having a dispensing opening therein, said cap body portion including a top portion raised above a shoulder and including a periphery therearound, said shoulder including a planar ramp portion; and a lid including a bottom wall hinged to said cap body by a hinge integrally formed between said cap body and said lid, said hinge including a central planar portion complementary with said cap body ramp portion and designed to abut said ramp portion when said lid is closed to exclude contamination and prevent seepage therearound, said cap body top planar portion having a minimal clearance between an upper surface thereof and said lid bottom wall when said lid is closed around said periphery of said cap body portion.

2. The closure as defined in claim 1 wherein said minimal clearance is on the order of 0.010 inches.

3. The closure as defined in claim 1 wherein said cap body top portion includes an inclined portion opposite said hinge.

4. The closure as defined in claim 3 wherein said inclined portion has an upper surface formed below said dispensing opening.

5. The closure as defined in claim 3 wherein said top portion and said inclined portion terminate above said shoulder.

6. The closure as defined in claim 1 wherein said lid hinge includes a pair of upstanding side shoulders adjacent said central planar portion an said cap body ramp portion includes a pair of grooves complementary to said side shoulders which are seated therein when said lid is closed.

7. The closure as defined in claim 1 wherein said hinge is a solid one-piece unitary hinge.

8. A watertight hinge closure, comprising:

a cap body portion adapted to be secured to a container having a dispensing opening therein, said cap body portion including a top portion raised above a shoulder and including a periphery therearound, said shoulder including a planar ramp portion; and a lid including a bottom wall hinged to said cap body by a solid one-piece unitary hinge integrally formed between said cap body and said lid, said hinge including a central planar portion complementary with said cap body ramp portion and designed to abut said ramp portion when said lid is closed to exclude contamination and prevent seepage therearound, said cap body top portion having a minimal clearance between an upper surface thereof and said lid bottom wall when said lid is closed around said periphery of said cap body portion.

9. The closure as defined in claim 8 wherein said minimal clearance is on the order of 0.010 inches.

10. The closure as defined in claim 8 wherein said lid hinge includes a pair of upstanding side shoulders adjacent said central planar portion and said cap body ramp portion includes a pair of grooves complementary to said side shoulders which are seated therein when said lid is closed.

11. The closure as defined in claim 10 wherein said inclined portion has an upper surface formed below said dispensing opening.

12. The closure as defined in claim 10 wherein said top portion and said inclined portion terminate above said shoulder.

13. The closure as defined in claim 8 wherein said cap body top portion includes an inclined portion opposite said hinge.

14. A watertight hinge closure, comprising:

a cap body portion adapted to be secured to a container having a dispensing opening therein, said cap body portion including a top portion and a shoulder including a planar ramp portion, said cap body top portion including an inclined portion opposite said hinge and said top portion and said inclined portion terminate above said shoulder;

a lid including a bottom wall hinged to said cap body by a hinge integrally formed between said cap body and said lid, said hinge including a central planar portion complementary with said cap body ramp portion and designed to abut said ramp portion when said lid is closed to exclude contamination and prevent seepage therearound; and said cap body top portion has a minimal clearance between an upper surface thereof and said lid bottom wall when said lid is closed.

15. A watertight hinge closure, comprising:

a cap body portion adapted to be secured to a container having a dispensing opening therein, said cap body portion including a top portion and a shoulder including a planar ramp portion;

a lid including a bottom wall hinged to said cap body by a hinge integrally formed between said cap body and said lid, said hinge including a central planar portion complementary with said cap body ramp portion and designed to abut said ramp portion when said lid is closed to exclude contamination and prevent seepage therearound; and said lid hinge includes a pair of upstanding side shoulders adjacent said central planar portion and said cap body ramp portion includes a pair of grooves complementary to said side shoulders which are seated therein when said lid is closed.

16. A watertight hinge closure, comprising;

a cap body portion adapted to be secured to a container having a dispensing opening therein, said cap body portion including a top portion and a shoulder including a planar ramp portion; and a lid including a bottom wall hinged to said cap body by a solid one-piece unitary hinge integrally formed between said cap body and said lid, said hinge including a central planar portion complementary with said cap body ramp portion and designed to abut said ramp portion when said lid is closed to exclude contamination and prevent seepage therearound, said cap body top portion having a minimal clearance between an upper surface thereof and said lid bottom wall when said lid is closed and said lid hinge includes a pair of upstanding side shoulders adjacent said central planar portion and said cap body ramp portion includes a pair of grooves complementary to said side shoulders which are seated therein when said lid is closed.

* * * * *